US011420215B2

(12) United States Patent
Rotermund

(10) Patent No.: US 11,420,215 B2
(45) Date of Patent: Aug. 23, 2022

(54) METHOD FOR EMPTYING SOLIDS FROM A CENTRIFUGE

(71) Applicant: GEA MECHANICAL EQUIPMENT GMBH, Oelde (DE)

(72) Inventor: Ulrich Rotermund, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 328 days.

(21) Appl. No.: 16/619,288

(22) PCT Filed: Jun. 1, 2018

(86) PCT No.: PCT/EP2018/064429
§ 371 (c)(1),
(2) Date: Dec. 4, 2019

(87) PCT Pub. No.: WO2018/224400
PCT Pub. Date: Dec. 13, 2018

(65) Prior Publication Data

US 2020/0188936 A1 Jun. 18, 2020

(30) Foreign Application Priority Data

Jun. 7, 2017 (DE) ..... 10 2017 112 553.1

(51) Int. Cl.
*B04B 1/16* (2006.01)
*B04B 9/10* (2006.01)
(Continued)

(52) U.S. Cl.
CPC ..... *B04B 1/16* (2013.01); *B04B 9/10* (2013.01); *B04B 11/04* (2013.01); *B04B 13/00* (2013.01)

(58) Field of Classification Search
CPC .. B04B 1/16; B04B 9/10; B04B 11/04; B04B 13/00; B04B 1/14
(Continued)

(56) References Cited

U.S. PATENT DOCUMENTS 5,244,584 A 9/1993 Schlieperskoetter
7,614,995 B2 11/2009 Schulz et al.
2012/0206071 A1* 8/2012 Keen ..... H02P 29/04 318/376

FOREIGN PATENT DOCUMENTS

CN 203608123 U * 5/2014
DE 654589 C 12/1937
(Continued)

OTHER PUBLICATIONS

EP 2196266 Description Espacenet English machine translation.*
(Continued)

*Primary Examiner* — Shuyi S. Liu
(74) *Attorney, Agent, or Firm* — Patent Portfolio Builders PLLC

(57) ABSTRACT

A method for clarifying a flowable starting product of solids using a self-emptying centrifuge in continuous operation in a centrifugal field in the rotating drum. A continuous draining of at least one clarified liquid phase occurs and solids emptying occurs repeatedly via outlet openings that are intermittently opened and closed. The emptying of solids from the drum of the centrifuge is initiated, the speed of the drum of the centrifuge is reduced, the solids are emptied from the solids collection chamber of the drum after lowering the speed of the drum, and the emptying of the solids from the drum is ended.

10 Claims, 2 Drawing Sheets

Figure 1:
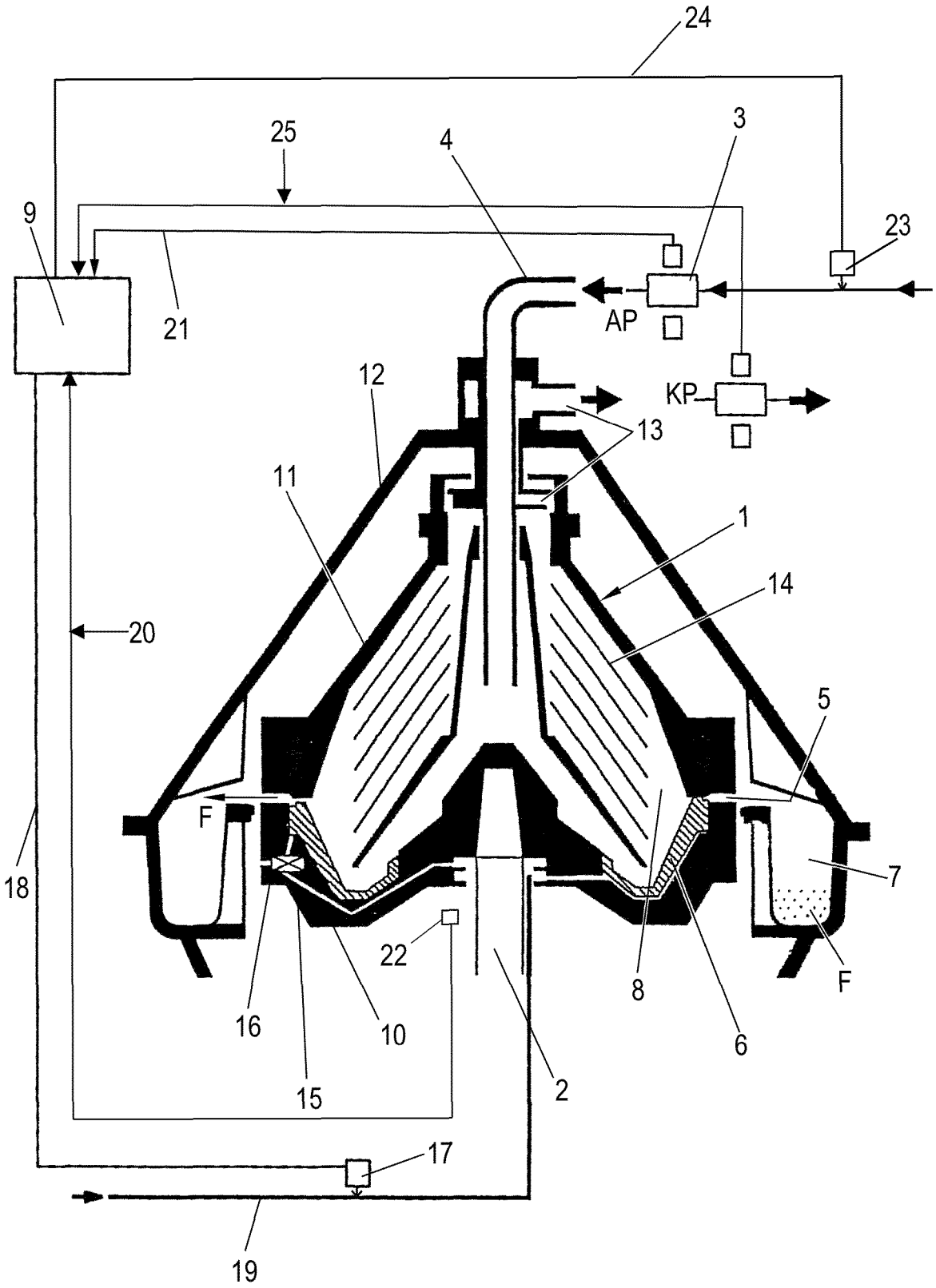

(51) Int. Cl.
*B04B 11/04* (2006.01)
*B04B 13/00* (2006.01)

(58) Field of Classification Search
USPC ..... 494/2, 4, 9, 10
See application file for complete search history.

(56) References Cited

FOREIGN PATENT DOCUMENTS

| | | | | |
|---|---|---|---|---|
| DE | 1861982 | U | | 11/1962 |
| DE | 7902524 | U1 | | 7/1979 |
| DE | 3743534 | A1 | | 7/1989 |
| DE | 4105412 | A1 | | 8/1992 |
| DE | 4317743 | A1 | | 12/1994 |
| DE | 10153483 | A1 | | 5/2003 |
| DE | 102005049941 | A1 | | 4/2007 |
| DE | 102008062055 | A1 | | 6/2010 |
| DE | 102015119165 | A1 | | 5/2017 |
| EP | 2196266 | A2 | * | 6/2010 |
| EP | 2196266 | A2 | | 6/2010 |
| GB | 423162 | A | | 1/1935 |
| GB | 423162 | A | * | 1/1935 |
| GB | 469338 | A | * | 7/1937 |
| GB | 469338 | A | | 7/1937 |
| WO | 2004054719 | A1 | | 7/2004 |

OTHER PUBLICATIONS

International Search Report dated Aug. 29, 2018 in related/corresponding International Application No. PCT/EP2018/064429.
Search Report dated Mar. 1, 2018 in related/corresponding DE Application No. 10 2017 112 553.1.
Written Opinion dated Aug. 29, 2018 in related/corresponding International Application No. PCT/EP2018/064429.

* cited by examiner

METHOD FOR EMPTYING SOLIDS FROM A CENTRIFUGE

BACKGROUND AND SUMMARY OF THE INVENTION

The invention relates to a method for clarifying a flowable starting product of solids using a self-emptying centrifuge.

The starting product to be clarified by a centrifugal drum, and therefore also the solids contained in the starting product—which can be waste materials, but also useful materials—are subjected to high centripetal acceleration which, in a separator with a vertical axis of rotation, can be more than 10,000 times greater than gravitational acceleration (more than 10,000 g). Due to the closed drum, the materials are held in the rotating system, in which a pressure accumulates which is proportional to the square of the angular velocity "$\omega^2$". If outlet channels—also referred to as outlet openings below—provided for discharging solids at the outer circumference of the drum open when emptying solids from the drum, the pressurized solid matter is pressed through these outlet channels at high velocity and therefore with high energy. In this respect, when emptying solids from a self-emptying separator at full speed, the solids, in particular abrasive solids, can cause wear on the delivery openings of the drum lower part, on the piston slide valve and on the drum cover.

To reduce this wear, it is known to protect vulnerable points externally and/or internally in the rotating system having the drum using protective plates and/or by using a coating made from a suitable hard material, e.g., hard metal (for example, WO 2004/054719A1). For particularly abrasive solids, however, it may still be necessary to replace the protective elements and/or other components of the drum that are damaged due to abrasion. To service these components by replacement, the centrifuge has to be decommissioned, which means that its availability is reduced.

Exemplary embodiments of the invention are directed to reducing this problem.

According to an embodiment, at least the following method steps are provided:

100: initiating the respective emptying of solids from the drum of the centrifuge;

200: reducing the speed of the drum of the centrifuge;

300: opening the outlet openings and emptying the solids from the solids collection chamber of the drum whilst or after the speed of the drum is reduced (according to a predetermined criterion);

400: closing the outlet openings and terminating the emptying of the solids from the drum.

By reducing the drum speed before the emptying procedure, the exit velocity of the solids and the kinetic energy of the solids exiting the drum are reduced considerably. This reduces the abrasive effect of the solids on the vulnerable points or components of the drum accordingly. As a result of these measures, the useful life of these components can be advantageously effectively extended and the availability of the centrifuge can be increased. Within the context of this document, the term "solid matter" refers to all materials that are to be emptied via the outlet openings of the drum. This can be, for example, turbid materials or impurities, but also auxiliary materials such as bentonite or useful materials such as algae, yeasts, cell cultures or microorganisms.

The reduced kinetic energy of the solids can moreover have an advantageous effect on the solids. This is because the exit velocity also results in a reduced impact velocity of the solids on the walls of a solids catcher surrounding the drum so that gentle solids delivery takes place, In particular for products to be processed (for example, fermentation broths) whereof the solids contain biological cells, the risk of the cells being partially damaged as a result of the solids emptying procedure is reduced accordingly. Purely by way of example, such solids can be yeast cells or algae cells.

In this case, a step 500, in which the speed of the drum of the centrifuge is increased again—in particular to a nominal speed—preferably follows the respective solids emptying procedure, in particular the step 400.

It is also conceivable and falls within the subject matter of the claims if the reduction in the speed is further continued during the emptying procedure and/or if the increase in the speed is already initiated again during the solids emptying procedure.

It has proven advantageous if, before a solids emptying procedure, a reduction in the speed of the drum of the centrifuge to ca. 30% to 80%, preferably 50% to 70% of the nominal speed, in particular the operating speed of the drum before the start of the solids emptying procedure, takes place. The amount by which the speed is suitably reduced in each case can be easily determined for each clarification process through experimentation. In this case, the speed should not be reduced to the extent that the solids delivery is impaired, for example due to solids which tend to clump as a result of the reduction in speed no longer being fully discharged or no longer being fully centrifuged from the clearances between the separating plates.

In a preferred embodiment of the inventive method, the initiation of the emptying of solids from the drum of the centrifuge in step 100 takes place as a result of a control pulse of the control unit. In this case, the emptying of the drum is initiated by the control unit when one or more predetermined conditions (e.g., increased turbidity in the drainage liquid, the elapse of a defined time interval since the last solids emptying procedure) are fulfilled.

The reduction in the speed of the drum is terminated after a defined emptying speed of the drum is reached. This is selected to ensure a gentle solids emptying procedure in a manner reducing abrasive wear.

According to a further embodiment of the inventive method, the reduction in the speed of the drum in step 200 is terminated after a defined time interval has elapsed. It is thus also possible to operate the drum during the solids emptying procedure at a speed ensuring a gentle solids emptying procedure in a manner that reduces abrasive wear.

In a preferred embodiment of the inventive method, the speed of the drum in step 200 is realized by means of a drive system having a regenerative brake, in particular having a frequency converter capable of energy feedback, wherein preferably regenerative electrical energy is generated thereby during the reduction in speed.

This advantageously enables the solids emptying procedure carried out according to the invention to be controlled a very energy-saving manner.

In this connection, it is advantageous if the drive system with energy feedback has a frequency converter by means of which the drive motor of the separator can also be operated in generator mode. By suitably selecting and controlling this frequency converter, the drive motor of the drive system can be quickly and therefore advantageously set to generator mode during the speed reduction process, which results in energy being fed back into the power supply system.

In a further embodiment of the inventive method, the speed of the drum, beginning at least at the start of step 100 up to the completion of step 500, is detected at defined discrete time intervals, preferably virtually continuously, by means of at least one sensor device. This enables the reduction in the speed of the drum and the re-acceleration of the drum to the nominal speed to be precisely controlled and monitored.

The termination of the solids emptying procedure preferably also takes place according to one or more conditions, for example after an interval has elapsed or after a further reduction in speed has been detected via a further loss of energy of the rotating system as a result of the solids delivery.

BRIEF DESCRIPTION OF THE DRAWING FIGURES

Figure 2:
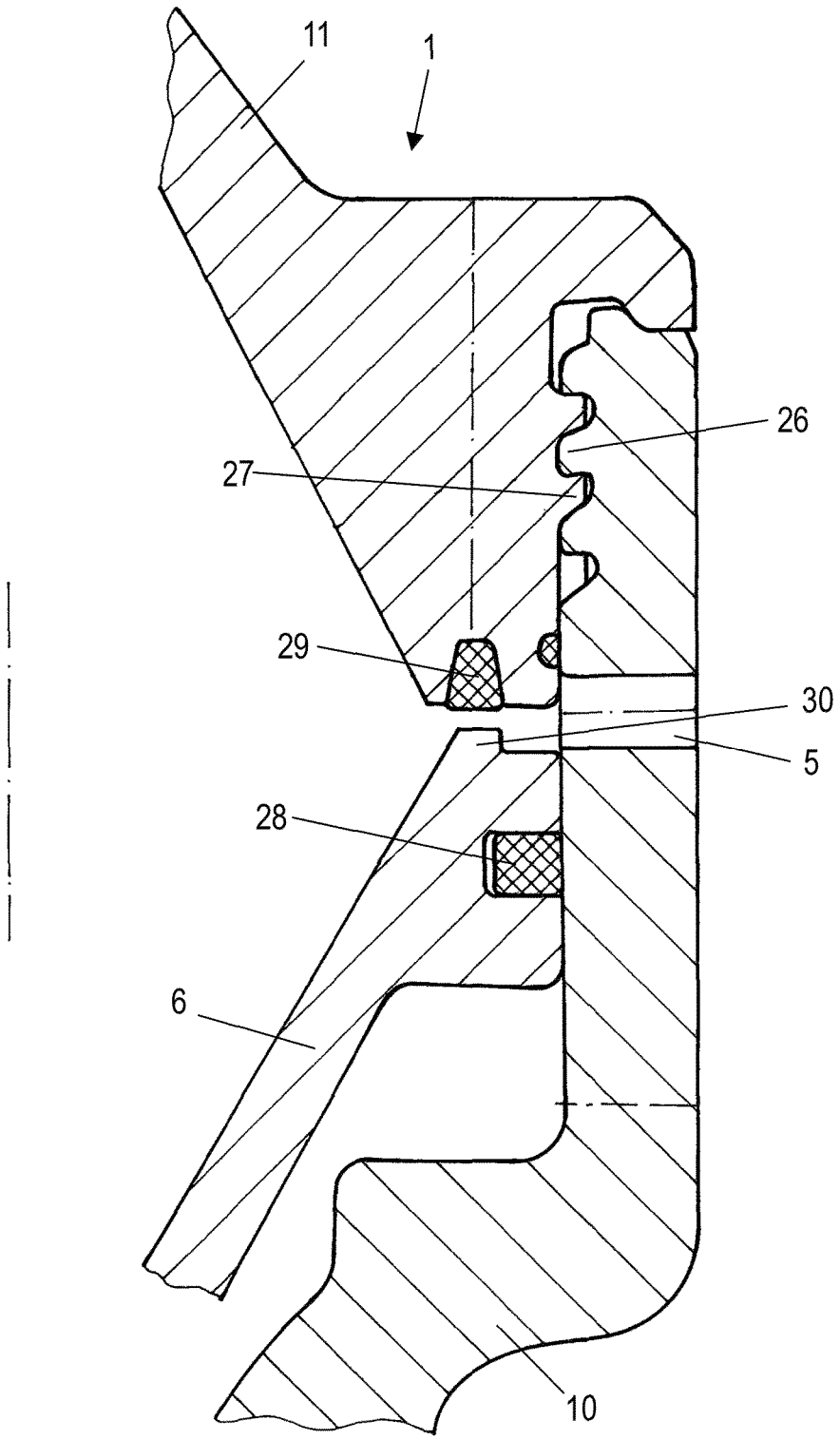

The invention will be explained in more detail below with the aid of a preferred exemplary embodiment with reference to the accompanying drawings, which show:

FIG. 1: a schematic sectional view of a centrifuge, which can be operated according to an inventive method;

FIG. 2: an enlarged detail of the drum.

DETAILED DESCRIPTION

FIG. 1 shows a centrifuge—designed as a separator here—for clarifying solids-containing, flowable starting products AP via the removal of solids, having a rotatable drum 1 with a vertical axis of rotation. The processing of the starting product AP takes place in a continuous operation. The separator is a self-emptying separator.

This means that the intake of the starting product AP takes place continuously and the discharge of at least a clarified liquid phase, referred to as clear phase KP, takes place continuously. In the configuration as a self-emptying separator, the drum 1 of the centrifuge provides discontinuous discharge of solids, wherein the solid matter F separated from the starting product AP via clarification is removed at intervals by opening and reclosing outlet nozzles or outlet openings 5.

The drum 1 has a drum lower part 10 and a drum cover 11. It is furthermore preferably surrounded by a hood 12. The drum 1 is moreover seated on a drive spindle 2, which is rotatably mounted and can be driven by a drive motor.

The drum 1 has a product intake 4, via which the starting product AP is channeled into the drum 1. It furthermore has at last one drain 13—provided with an impeller—which serves for discharging a clear phase KP from the drum 1. The impeller 1—also referred to as a skimmer disk—is a centripetal pump. The drain 13 can be realized in a structurally different manner or by other means. In addition to the clarification, it is moreover also conceivable to also carry out separation of the starting product AP into two liquid phases of different densities. To this end, a further liquid drain is then required.

The drum 1 preferably has a plate stack 14 comprising axially spaced separating plates. A solids collection chamber 8 is formed between the outer circumference of the plate stack 14 and the inner circumference of the drum 1 in the region of the largest internal diameter thereof. Solids separated from the clear phase in the region of the plate stack 14 collect in the solids collection chamber 8, from which the solids F can be delivered from the drum 1 via outlet openings 5.

To this end, the outlet openings 5 can be opened and closed by means of a piston slide valve 6, which is arranged in the drum lower half 10 and is displaceable therein, parallel to the axis of rotation (in particular vertically). When the outlet openings 5 are open, the solid matter F is discharged from the drum 1 into a solids catcher 7. The solids collecting chamber 8 in the drum 1 has a defined solids chamber volume.

To move the piston slide valve 6, the drum 1 has an actuating mechanism. In this case, this comprises at least one supply line 15 for a control fluid such as water and a valve arrangement 16 in the drum 1 and further elements outside the drum 1. The intake of the control fluid, such as water, is therefore enabled via a dosing arrangement 17 arranged outside the drum 1, which is associated with an intake line 19 arranged outside the drum 1 for the control fluid so that, for a solids emptying procedure for the solid matter F, the control fluid can be introduced into the drum 1 by opening the valve arrangement 16 or, conversely, the supply flow of control fluid can be interrupted to move the piston slide valve 6 accordingly in order to open the outlet openings 5.

At least one sensor device 22 can be arranged on the spindle 2 and/or the drum 1, which sensor device 22 is designed to determine the current speed of the spindle 2 or the current speed of the drum or the rotating system of the centrifuge. The at least one sensor device 22 can function in accordance with the induction operating principle, for example. Alternatively, the sensor device 22 can also function in accordance with a different operating principle.

A sensor device 3 for determining the throughflow rate volume/time or one or more parameters such as mass/time of the starting product AP to be channeled into the drum 1 can likewise be arranged on or in the intake 4 for the starting product AP leading into the drum 1. This is advantageous but not compulsory.

The sensor devices 3 and 22 are connected via data connections 20, 21 to the evaluation and control unit 9 (preferably a control computer of the centrifuge), which evaluates or correlates the determined measured values and controls the movement of the piston slide valve 6 and therefore also the time interval until the outlet openings 5 are opened.

The actuating mechanism for the piston slide valve 6—in particular the dosing arrangement 17 here—can be connected via a data connection 18 to an evaluation and control unit 9, which also has a program routine for control and/or regulation of the solids discharge, which also executes this as a program or part of a program. The dosing arrangement 17 can have, for example, a piston and one or more valves. It can furthermore be configured in the manner according to DE 10 2005 049 941 A1 to enable alterable dosing of the fluid quantity to be implemented for controlling and altering the duration of the solids emptying procedure and therefore the current solids emptying volume. The solids emptying volume can also be varied by means of the dosing arrangement 17 so that, in the case of an increasing solids content in the intake, for example, the solids emptying volume can be increased.

A further controllable device 23—for example a controllable valve—can also be connected into the intake 4, by means of which the volume flow in the intake can be altered to alter the intake quantity or the current intake volume $V_{AP}$ of starting product AP to be processed per unit time. This controllable device 23 is connected to the control unit 9 via a data connection 24.

The above-mentioned data connections 18, 20, 21, 24, 25 enable data transfer from or to the control and evaluation unit 9. They can be configured as lines in each case or as wireless connections in each case.

An enlarged detail of the portion of the drum 1 which has one of the outlet openings 5 is shown in section in FIG. 2.

The drum cover 11 is screwed to the drum lower part 10. Accordingly, the drum lower part 10 has an internal thread 26 and the drum cover 11 has an external thread 27.

The piston slide valve 6 moves in the drum lower part 10 and has a seal 28 with which the space between the piston slide valve 6 and the drum lower part 10 is sealed with respect to a remaining interior space of the drum 1. The drum cover 11 has a seal 29 against which, in the closed state of the outlet opening 5 (not shown here), an axial shoulder 30 abuts, which is integrally formed on the piston slide valve 6.

In the open state of the outlet openings 5, the seal 29 and the shoulder 30 and also the regions of the drum cover 11 and the drum lower part 10 facing the interior space of the drum and each adjoining the outlet opening 5 are therefore in particular subjected to considerable abrasive wear when the solid matter F is emptied via the outlet opening 5.

Replacement of the seal 29 or the piston slide valve 6 due to wear or compensation of wear on the shoulder 30, e.g., by weld cladding and post-machining, are associated with decommissioning of the centrifuge and are therefore linked to dismantling and assembly costs.

An exemplary embodiment of an emptying method which reduces abrasive wear and can be carried out by the centrifuge described above is explained below with the aid of the figures.

The starting product AP is preferably discontinuously channeled into the drum 1 of the centrifuge, where it is clarified. Continuous clear-phase discharge of the clear phase KP takes place.

During the clarification of the starting product AP with formation of the clear phase KP, turbid materials and other solids contained in the starting product AP are collected in the solids collection chamber 8 of the drum 1 outside the plate stack 14, which becomes filled.

This variant of the method is based on the fact that, before the emptying of the solids collection chamber 8, a drop in speed of the drum 1 is brought about deliberately and in a defined manner to reduce the energy with which the solid matter F exits the drum the drum 1 when the outlet openings 5 are opened and therefore to minimize the abrasive wear caused by the solid matter F on parts within and outside the drum 1 and at the outlet openings 5 of the drum 1 during the solids emptying procedure.

To bring about the drop in speed of the drum 1, it can be provided that the speed of the drive motor of the centrifuge is reduced by a defined amount via a frequency converter, wherein the braking time until an emptying speed of the drum 1 is reached is shortened considerably by a braking resistor or by a drive system with energy feedback and whereby electrical energy can be advantageously fed back into the power supply system.

It can furthermore be provided that the speed of the drum 1 is detected at least during the time interval in which the drum 1 revolves at a speed which, since it is reduced, deviates from the nominal speed. Control pulses can thus be specifically triggered, which contribute to accelerating the drop in speed so that the requirement of the method for a solids emptying procedure which reduces the abrasive wear can be met as quickly as possible and the solids emptying procedure for the solid matter F can take place without substantial delay.

For emptying solid matter F from a centrifuge in a manner which reduces abrasive wear, the following method is indicated:

The method starts in step 100. In step 100, the emptying of solids from the drum 1 of the centrifuge is initiated, for example, by a control pulse of the control unit 9.

Then, in a step 200, the speed of the drum 1, starting from the given starting speed/nominal speed, is reduced in a defined manner. This can take place in that the speed of the drum 1 is reduced to a defined emptying speed. Alternatively, it is also possible to allow a defined time interval to elapse whilst the speed of the drum 1 is reduced.

The braking time until an emptying speed of the drum 1 or the defined time interval is reached is advantageously considerably shortened by a braking resistor or by a drive system with energy feedback, wherein, with the use of a drive system with energy feedback, electrical energy is advantageously fed back into the power supply system. The drive system with energy feedback preferably contains a frequency converter.

In a further step 300, after reaching the defined emptying speed or after the defined time interval has elapsed, the solid matter F is emptied from the solids collection chamber 8 via the outlet openings 5 of the centrifuge with the aid of the piston slide valve 6 thereof.

Then, in a step 400, the solids emptying procedure for the solid matter F is terminated with the aid of the piston slide valve.

In a subsequent step 500, the drum 1 of the centrifuge is accelerated to the nominal speed again.

Within the framework of the method, at least at the start of the reduction in speed until the nominal speed of the drum 1 is reached again, the speed of the drum 1 is detected at defined discrete time intervals, preferably virtually continuously, by the sensor device 22 or another speed measuring device.

All in all, by means of the method illustrated and claimed, the availability of the centrifuge is advantageously increased and the maintenance intervals of the centrifuge are likewise advantageously significantly extended. Moreover, substances which are to be emptied from the drum at a reduced speed are subject to considerably less damage.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Drum
2 Spindle
3 Sensor
4 Intake
5 Outlet openings
6 Piston slide valve

7 Solids catcher
8 Solids collection chamber
9 Control unit
10 Drum lower part
11 Drum cover
12 Hood
13 Drain
14 Plate stack
15 Line for hydraulic fluid
16 Valve
17 Dosing arrangement
18 Data connection
19 Hydraulic line
20 Data connection
21 Data connection
22 Sensor device
23 Controllable device
24, 25 Data connection
26 Internal thread
27 External thread
28 Seal
29 Seal
30 Shoulder
KP Clear phase
AP Starting product
F Solid matter

The invention claimed is:

1. A method for clarifying a flowable starting product of solids using a self-emptying centrifuge, the method comprising:

operating the self-emptying centrifuge in a continuous operation in a centrifugal field in a rotating drum of the self-emptying centrifuge and continuously discharging at least a clarified liquid phase from the self-emptying centrifuge, wherein the self-emptying centrifuge comprises an intake for the flowable starting product, at least one liquid outlet for the continuous discharge of at least the clarified liquid phase, discontinuously openable and closable outlet openings for discharging solid matter from the rotating drum, and a control unit;

initiating, by the control unit, emptying of solids from the rotating drum via the discontinuously openable and closable outlet openings;

reducing a rotation speed of the rotating drum;

opening the discontinuously openable and closable outlet openings and emptying the solids from a solids collection chamber of the rotating drum subsequent to the reduction of the rotation speed of the rotating drum and while the rotation speed of the drum is reduced, wherein the opening of the discontinuously openable and closable outlet openings is caused by the control unit controlling movement of a controllable piston slide valve; and closing the discontinuously openable and closable outlet openings and terminating the emptying of the solids from the rotating drum, wherein the closing of the discontinuously openable and closable outlet openings is caused by the control unit controlling the movement of the controllable piston slide valve.

2. The method of claim 1, further comprising:

increasing the rotation speed of the rotating drum after terminating the emptying of the solids from the rotating drum.

3. The method of claim 1, wherein the initiation of the emptying of solids from the rotating drum is performed responsive to a control pulse of the control unit based on one or more activation criteria for a solids emptying procedure.

4. The method of claim 1, wherein the reduction of the rotation speed of the rotating drum is terminated after a defined emptying speed of the rotating drum is reached.

5. The method of claim 1, wherein the reduction in the rotation speed of the rotating drum is terminated after a defined time interval has elapsed.

6. The method of claim 1, wherein the reduction in the rotation speed of the rotatable drum is between 50% to 70% a rotation speed prior initiating the emptying of solids from the rotating drum.

7. The method of claim 1, wherein the rotation speed of the drum is reduced using a drive system having a regenerative brake.

8. The method of claim 7, wherein the drive system is a frequency converter providing energy feedback.

9. The method of claim 1, wherein the self-emptying centrifuge includes a sensor configured to determine the rotation speed of the rotating drum.

10. The method of claim 1, wherein the control unit causes the movement of the controllable piston slide valve by controlling a flow of hydraulic fluid.

* * * * *